US009466874B2

(12) United States Patent
Wang et al.

(10) Patent No.: US 9,466,874 B2
(45) Date of Patent: Oct. 11, 2016

(54) ANTENNA AND ELECTRONIC DEVICE USING SAME

(71) Applicants: Chao Wang, Shenzhen (CN); Yongli Chen, Shen (CN)

(72) Inventors: Chao Wang, Shenzhen (CN); Yongli Chen, Shen (CN)

(73) Assignee: AAC Technologies Pte. Ltd., Singapore (SG)

( * ) Notice: Subject to any disclaimer, the term of this patent is extended or adjusted under 35 U.S.C. 154(b) by 95 days.

(21) Appl. No.: 14/269,296

(22) Filed: May 5, 2014

(65) Prior Publication Data

US 2014/0333488 A1 Nov. 13, 2014

(30) Foreign Application Priority Data

May 7, 2013 (CN) ..... 2013 1 0165181

(51) Int. Cl.
*H01Q 1/24* (2006.01)
*H01Q 9/04* (2006.01)
*H01Q 5/371* (2015.01)

(52) U.S. Cl.
CPC ..... *H01Q 1/243* (2013.01); *H01Q 5/371* (2015.01); *H01Q 9/0421* (2013.01)

(58) Field of Classification Search
CPC ..... H01Q 1/243; H01Q 5/371; H01Q 9/0421
USPC ..... 343/702
See application file for complete search history.

(56) References Cited

U.S. PATENT DOCUMENTS

| | | | | |
|---|---|---|---|---|
| 6,285,324 | B1 * | 9/2001 | Korisch | H01Q 1/243 333/26 |
| 7,764,236 | B2 * | 7/2010 | Hill | H01Q 1/243 343/702 |
| 9,136,594 | B2 * | 9/2015 | Shi | H01Q 9/0421 |
| 2005/0057400 | A1 * | 3/2005 | Yuanzhu | H01Q 5/378 343/700 MS |
| 2007/0096987 | A1 * | 5/2007 | Bancroft | H01Q 1/243 343/700 MS |
| 2010/0156726 | A1 * | 6/2010 | Montgomery | H01Q 7/00 343/700 MS |

* cited by examiner

*Primary Examiner* — Dameon E Levi
*Assistant Examiner* — Hasan Islam
(74) *Attorney, Agent, or Firm* — Na Xu; IPro, PLLC

(57) ABSTRACT

The present disclosure provides an antenna and an electronic device using same. The antenna includes an antenna radiating element for radiating signals, a capacitive feed plate separated from and substantially parallel to the antenna radiating element for carrying out capacitive feed on the antenna radiating element, and a FPC antenna electrically connecting with the capacitive feed plate for feeding for the capacitive feed plate. The FPC antenna includes a plate-shaped main body, a feeding end, a ground end, an extending portion for being electrically connected with the capacitive feed plate, and a feeding strip extending vertically from the extending portion for improving the low-frequency performance of the antenna.

7 Claims, 5 Drawing Sheets

ANTENNA AND ELECTRONIC DEVICE USING SAME

FIELD OF THE INVENTION

The disclosure described herein relates to electronic devices, and more particularly to an antenna used in such an electronic device.

DESCRIPTION OF RELATED ART

Nowadays, an electronic device, such as a phone, for obtaining a fashion appearance, which uses a metal shell is desired. Compared with other shells made of other materials, metal shells not only have a fashion appearance, but also have many other advantages, such as a better stiffness, a greater strength, a thinner thickness, recyclable, a better heat radiation and so on. However, a metal shell will form a fatal electromagnetic shielding effect to an antenna located therein. For solving that problem, some phone designs, such as iPhone design, use a metal frame antenna to feed for the metal shell directly. Although this design solves the problem of antenna radiating in metallic environment, but a new problem appears. When a phone using a metal frame antenna to feed for the metal shell directly is being holded by a hand, the hand will affect the performance of the metal frame antenna devastatingly.

The present disclosure is accordingly provided to solve the problems mentioned above.

DETAILED DESCRIPTION OF THE EXEMPLARY EMBODIMENTS

Reference will now be made to describe exemplary embodiments of the present disclosure in detail.

Figure 1:
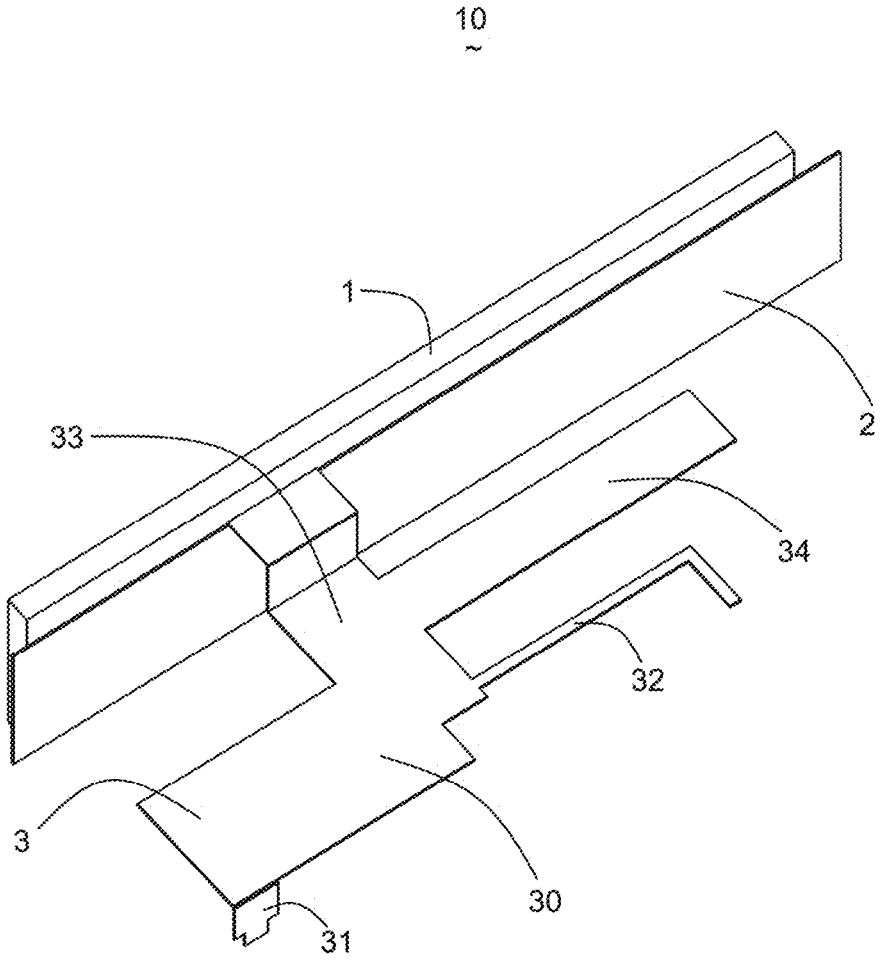
FIG. 1 is an isometric view of an antenna according to an exemplary embodiment of the present disclosure.

Referring to FIG. 1, the present disclosure provides an antenna 10 adapted to be used in an electronic device. The antenna 10 includes an antenna radiating element 1 for radiating signals, a capacitive feed plate 2 separated from and substantially parallel to the antenna radiating element 1, and an FPC antenna 3 electrically connecting with the capacitive feed plate 2 for feeding for the capacitive feed plate 2. The capacitive feed plate 2 is used for carrying out capacitive feed on the antenna radiating element 2.

Due to the capacitive coupling effect, the capacitive feed plate 2 feeds radio frequency energy to the antenna radiating element 1 without contacting with the antenna radiating element 1.

The FPC antenna 3 includes a plate-shaped main body 30, a feeding end 31 and a ground end 32 both extending from the main body 30, an extending portion 33 extending from the main body 30 for electrically connecting with the capacitive feed plate 2, and a feeding strip 34 extending vertically from the extending portion 33 and substantially perpendicular to the capacitive feed plate 2, which is configured for improving the low-frequency performance of the antenna 10. In this embodiment, the FPC antenna 3 is intergrated with the capacitive feed plate 2, and both of them are made of metal. The FPC antenna 3 is a feeding portion of the antenna 10. For ensuring the feeding energy to pass through the FPC antenna 3 effectively without reflecting, the length and width of the FPC antenna 3 are designed specially according to actual requirements.

In this embodiment, the FPC antenna 3 is designed to be a PIFA (Planar Inverted F-shaped Antenna) configuration, which means the FPC antenna 3 has two pins, the feeding end 31 and the ground end 32.

Figure 2:
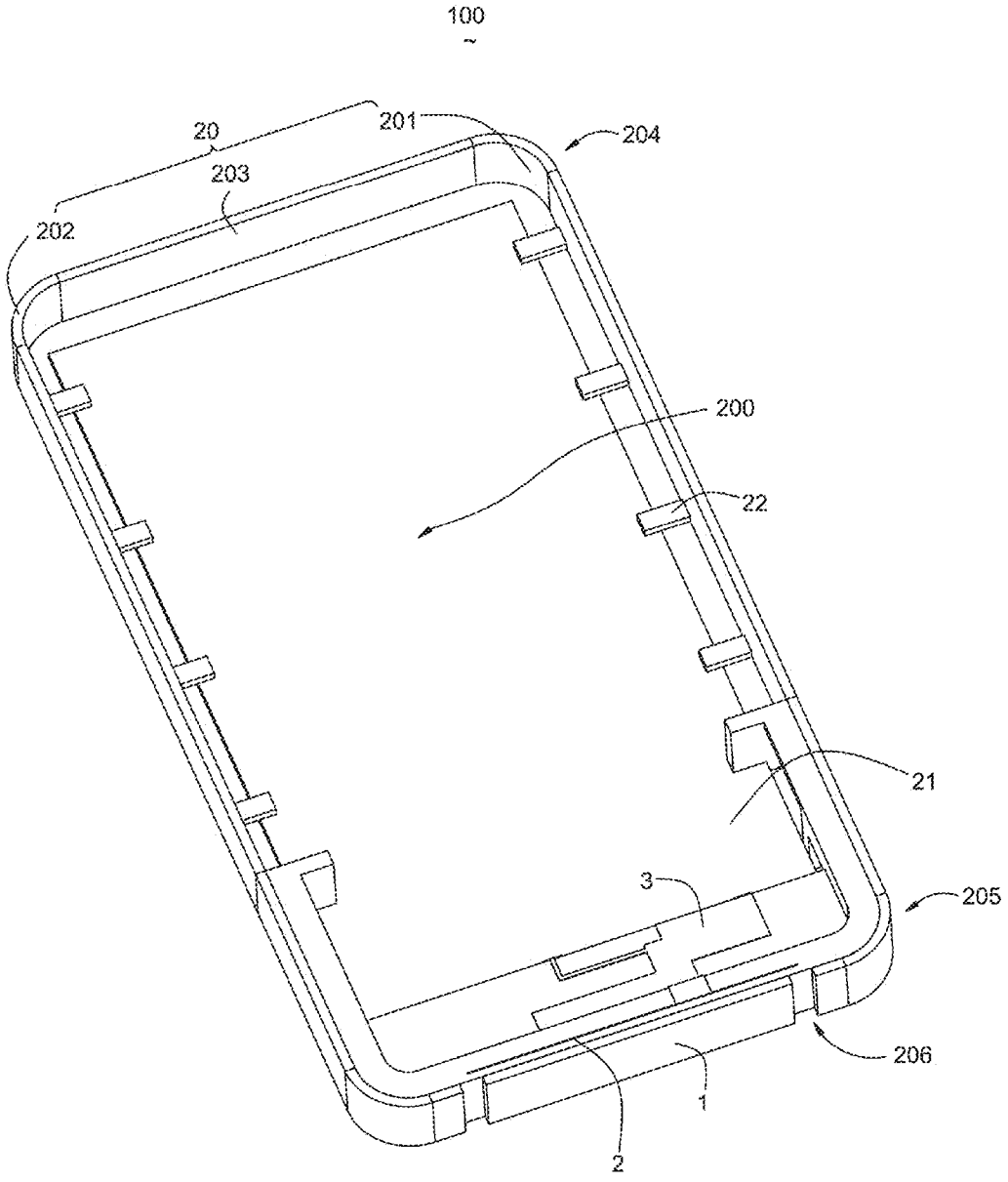
FIG. 2 is an isometric view of an electronic device using the antenna shown in FIG. 1, from a first aspect.
Figure 3:
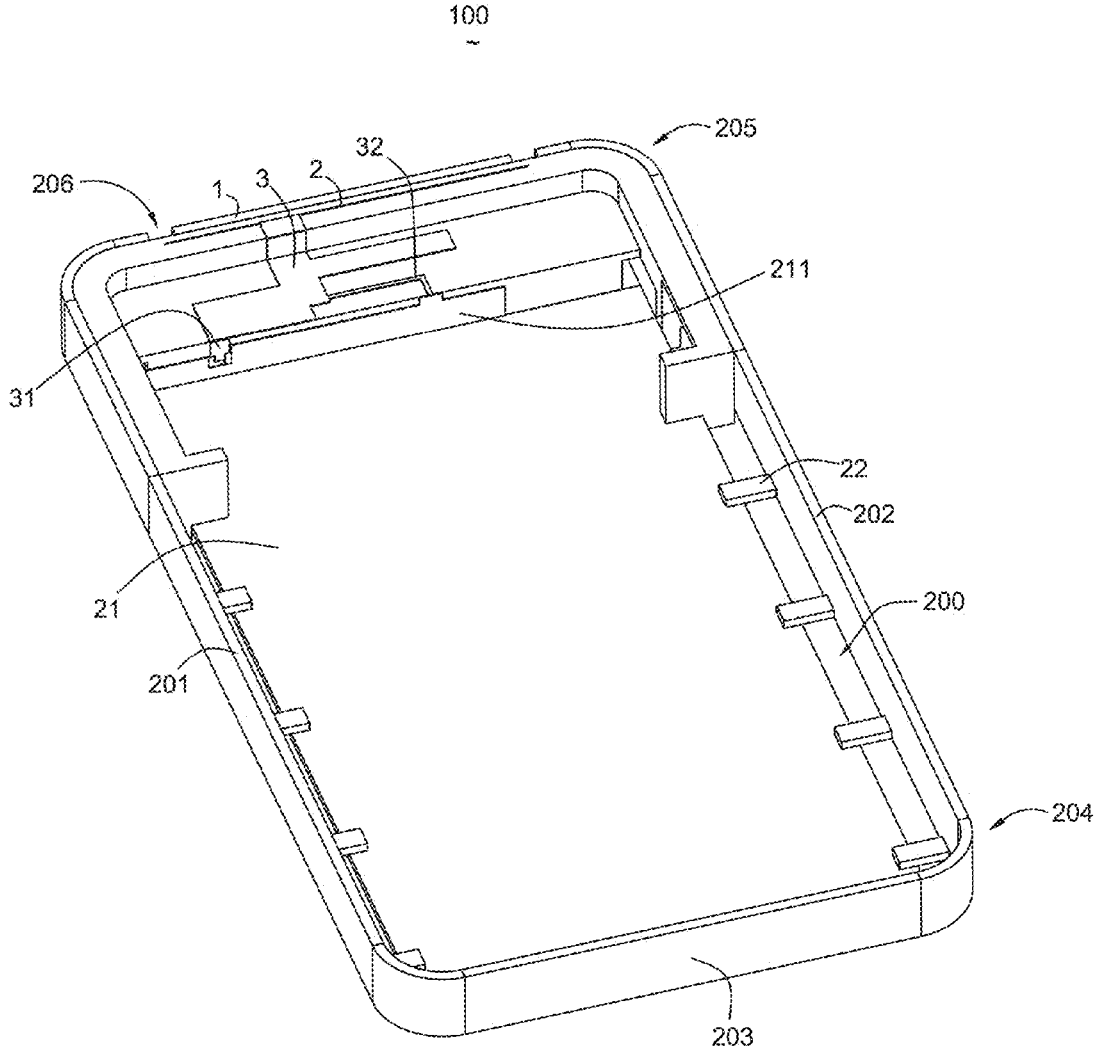
FIG. 3 is an isometric view of the electronic device in FIG. 2, from a second aspect.

Referring to FIGS. 1-3, the antenna 10 is used in an electronic device 100. The electronic device 100 may be a mobile phone, or other devices using antennas.

The electronic device 100 includes a metal frame 20. The metal frame 20 includes a first holding portion 201, and a second holding portion 202 opposite and substantially parallel to the first holding portion 201. The frame 20 further includes a connection portion 203 connecting the first holding portion 201 to the second holding portion 202 at a first end 204 of the frame 20. The first and second holding portions 201, 202 cooperatively form a gap 206 at a second end 205 of the frame 20.

The antenna radiating element 1 is positioned in the gap formed by the first holding portion 201 and the second holding portion 202 at the second end 205, not contacting with the first holding portion 201 and the second holding portion 202. A receiving space 200 is accordingly formed and surrounded by the first holding portion 201, the second holding portion 202, the connection portion 203, and the antenna radiating element 1. The capacitive feed plate 2 and the FPC antenna 3 are accommodated in the receiving space 200.

The electronic device 100 further includes a PCB (printed circuit board) 21 accommodated in the receiving space 200.

A metal plate-shaped PCB ground 211 is mounted on and substantially perpendicular to the PCB 21. The PCB ground 211 is electrically connected to the PCB 21. The ground end 32 is electrically connected to the PCB ground 211. In an alternative embodiment, the PCB ground 211 has a long feeding strip plate-shaped.

Each of the first and second holding portions 201, 202 includes a ground terminal 22 extending therefrom into the receiving space 200. Particularly, the ground terminal 22 of the first holding portion 201 extends from an inner surface of the first holding portion 201 toward an inner surface of the second holding portion 202. Same, the ground terminal 22 of the second holding portion 202 extends from an inner surface of the second holding portion 202 toward the inner surface of the first holding portion 201. The ground terminal 22 of the first holding portion 201 is symmetrical with and separated from the ground terminal 22 of the second holding portion 202. The ground terminal 22 is electrically connected to the PCB 21.

Due to the special design of the ground terminals 22, a coupling effect is formed by the antenna radiating element 1 and the first and second holding portions 201, 202. The ground terminals 22 improve the low-frequency radiating of the antenna 10. Furthermore, the antenna 10 realizes double-resonance, and the bandwidth of the low-frequency of the antenna 10 is accordingly expanded. Simultaneously, due to the special design of the ground terminals 22, the size and the area of the FPC antenna 3 are reduced.

Figure 4:
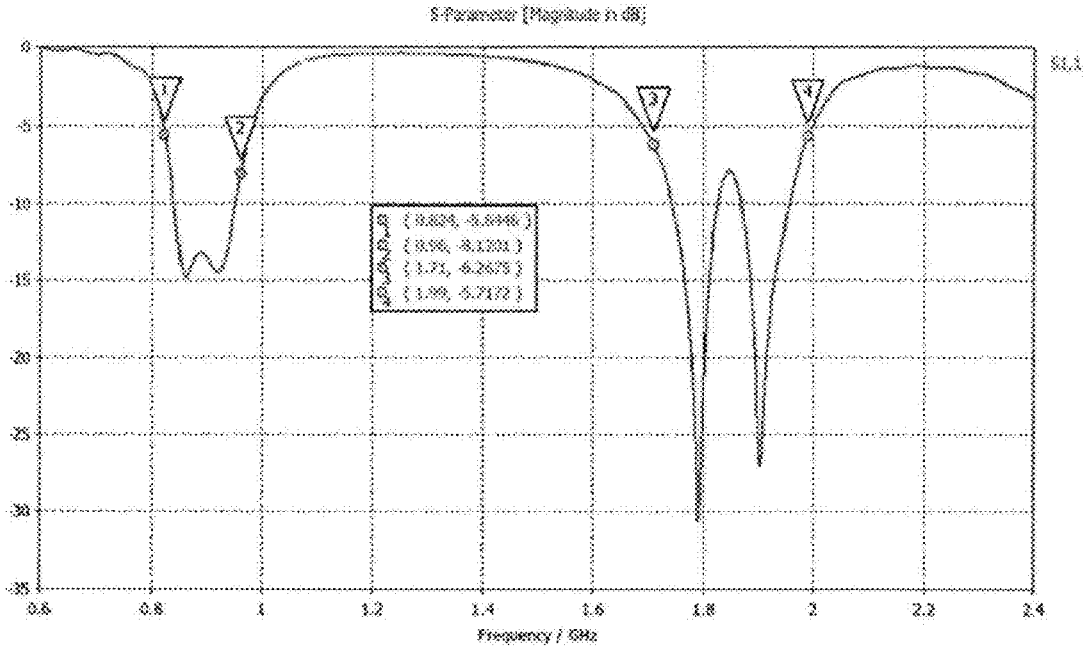
FIG. 4 shows an S11 curve of the antenna shown in FIG. 1 used in the electronic device.
Figure 5:
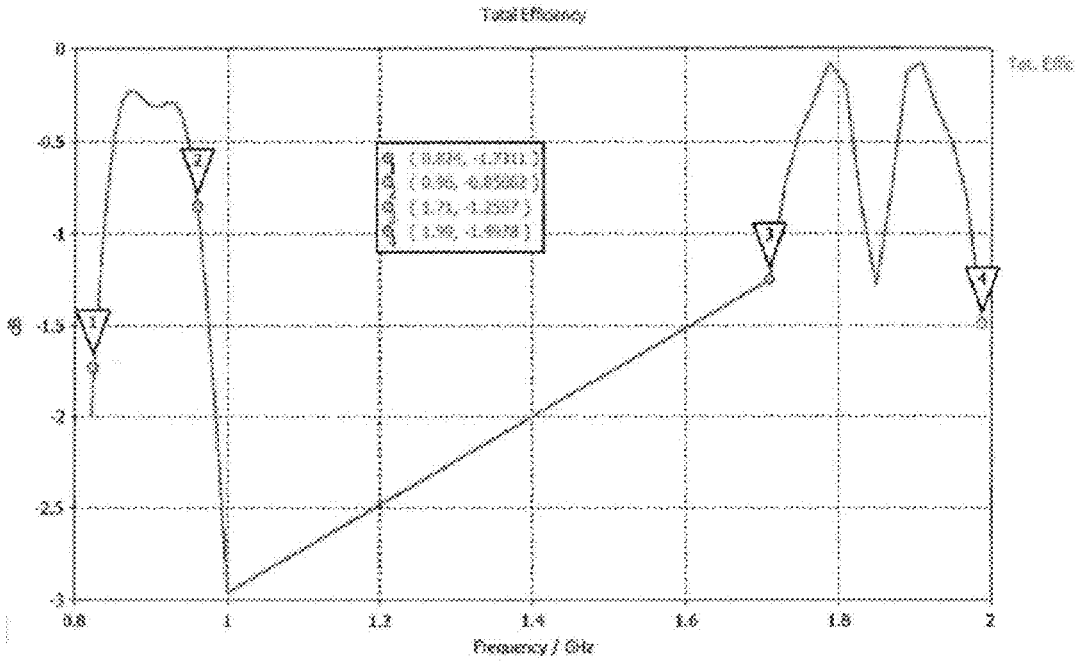
FIG. 5 shows a radiating rate curve of the antenna shown in FIG. 1 used in the electronic device.

Referring to FIGS. 4 and 5, when the electronic device 100 is holded, the antenna 10 provided by the present disclosure can work at high frequency band and low frequency band. The radiating rate of the antenna 10 is improved approximately 20~30%. The present disclosure solves the problem that when the electronic device 100 is holded the performance of the antenna 10 will be affected.

While the present disclosure has been described with reference to the specific embodiments, the description of the disclosure is illustrative and is not to be construed as limiting the disclosure. Various of modifications to the present disclosure can be made to the exemplary embodiments by those skilled in the art without departing from the true spirit and scope of the disclosure as defined by the appended claims.

What is claimed is:

1. An antenna for being used in an electronic device, comprising:

an antenna radiating element for radiating signals;

a capacitive feed plate spaced from and substantially parallel to the antenna radiating element for carrying out capacitive feed on the antenna radiating element;

an FPC antenna electrically connecting with the capacitive feed plate for feeding for the capacitive feed plate;

wherein the FPC antenna comprises:

a plate-shaped main body, a feeding end and a ground end both extending from the main body, an extending portion extending from the main body for electrically connecting with the capacitive feed plate, and a feeding strip extending vertically from the extending portion and substantially perpendicular to the capacitive feed plate, which is configured for improving the low-frequency performance of the antenna;

the electronic device comprises a metal frame, wherein the metal frame comprises a first holding portion, a second holding portion opposite and parallel to the first holding portion, and a connection portion connecting the first holding portion to the second holding portion at a first end of the frame;

the antenna radiating element is positioned in a gap formed by the first holding portion and the second holding portion at a second end, not contacting with the first holding portion and the second holding portion, wherein a receiving space is accordingly formed and surrounded by the first holding portion, the second holding portion and the connection holding portion;

wherein the antenna radiating element, the capacitive feed plate, and the FPC antenna are accommodated in the receiving space.

2. The antenna as described in claim 1, wherein the FPC antenna is integrated with the capacitive feed plate.

3. An electronic device comprising:

an antenna, wherein the antenna comprises:

an antenna radiating element for radiating signals;

a capacitive feed plate spaced from the antenna radiating element and parallel to the antenna radiating element for carrying out capacitive feed on the antenna radiating element;

an FPC antenna electrically connecting with the capacitive feed plate for feeding for the capacitive feed plate;

wherein the FPC antenna comprises:

a plate-shaped main body, a feeding end and a ground end both extending from the main body, an extending portion extending from the main body for electrically connecting with the capacitive feed plate, and a feeding strip extending vertically from the extending portion and perpendicular to the capacitive feed plate, which is configured for improving the low-frequency performance of the antenna;

the electronic device further comprises a metal frame, wherein the metal frame comprises a first holding portion, a second holding portion opposite and parallel to the first holding portion, and a connection portion connecting the first holding portion to the second holding portion at a first end of the frame;

the antenna radiating element is positioned in a gap formed by the first holding portion and the second holding portion at a second end, not contacting with the first holding portion and the second holding portion, wherein a receiving space is accordingly formed and surrounded by the first holding portion, the second holding portion and the connection holding portion;

wherein the antenna radiating element, the capacitive feed plate, and the FPC antenna are accommodated in the receiving space.

4. The electronic device as described in claim 3 further comprising a PCB, wherein the PCB is accommodated in the receiving space.

5. The electronic device as described in claim 4, wherein the PCB comprises a metal plate-shaped PCB ground perpendicular to the PCB, wherein the ground end is electrically connected to the PCB ground.

6. The electronic device as described in claim 5, wherein each of the first and second holding portions includes a ground terminal extending therefrom into the receiving space, the ground terminal of the first holding portion extends from an inner surface of the first holding portion toward an inner surface of the second holding portion, the ground terminal of the second holding portion extends from an inner surface of the second holding portion toward the inner surface of the first holding portion, and the ground terminal is electrically connected to the PCB.

7. The electronic device as described in claim 6, wherein the ground terminal of the first holding portion is symmetrical with and spaced from the ground terminal of the second holding portion.

* * * * *